United States Patent [19]

Yates et al.

[11] 4,173,169

[45] Nov. 6, 1979

[54] SEMI-AUTOMATIC FIREARM

[76] Inventors: Patrick Yates, P.O. Box 5779, China Lake, Calif. 93555; Sydney H. Woodcock, Penthouse Seattle Tower, 3rd & University, Seattle, Wash. 98101; Jeffrey R. Beals, 11216 Phinney Ave. North, Seattle, Wash. 98133

[21] Appl. No.: 794,738

[22] Filed: May 9, 1977

Related U.S. Application Data

[63] Continuation-in-part of Ser. No. 692,297, Jun. 8, 1976, abandoned.

[51] Int. Cl.[2] ..... F41D 11/00

[52] U.S. Cl. ..... 89/132; 42/1 S; 89/163; 89/198; 89/199

[58] Field of Search ..... 89/163, 196

[56] References Cited

U.S. PATENT DOCUMENTS

| | | | |
|---|---|---|---|
| 580,924 | 4/1897 | Browning | 89/163 |
| 984,519 | 2/1911 | Browning | 89/163 |
| 3,504,594 | 4/1970 | Greeley | 89/163 |
| 3,564,967 | 2/1971 | LaViolette et al. | 89/163 |
| 3,975,982 | 8/1976 | Terstegge | 89/163 |

*Primary Examiner*—Stephen C. Bentley

*Attorney, Agent, or Firm*—Seed, Berry, Vernon & Baynham

[57] ABSTRACT

A semi-automatic firearm having a slide axially movable with respect to a frame between a forward battery position where the firearm is discharged, and a full recoil position where the spent cartridge is extracted and a new cartridge is subsequently loading. Either a pair of oppositely wound, concentric springs or a flat helical spring extends between the slide and the frame to form a recoil mechanism which resiliently biases the slide toward battery. The slide partially surrounds a barrel which is pivotally secured to the frame toward its rear end through a link. The slide contacts the barrel at a point diametrically spaced from the link when the slide is in battery thereby resiliently biasing the barrel in a forward direction which imparts a rotational moment to the barrel about the pivot axis of the link. The rotational moment forces the front end of the barrel downwardly against two distinct support areas on the slide. Consequently the barrel is supported by three fixed points which define a stable mounting plane for the barrel. Alternative embodiments of the firearm include a rearwardly extending sight secured to the forward end of the barrel, and a shock absorbing cap receiving the forward end of the recoil spring.

17 Claims, 11 Drawing Figures

FIG. 1
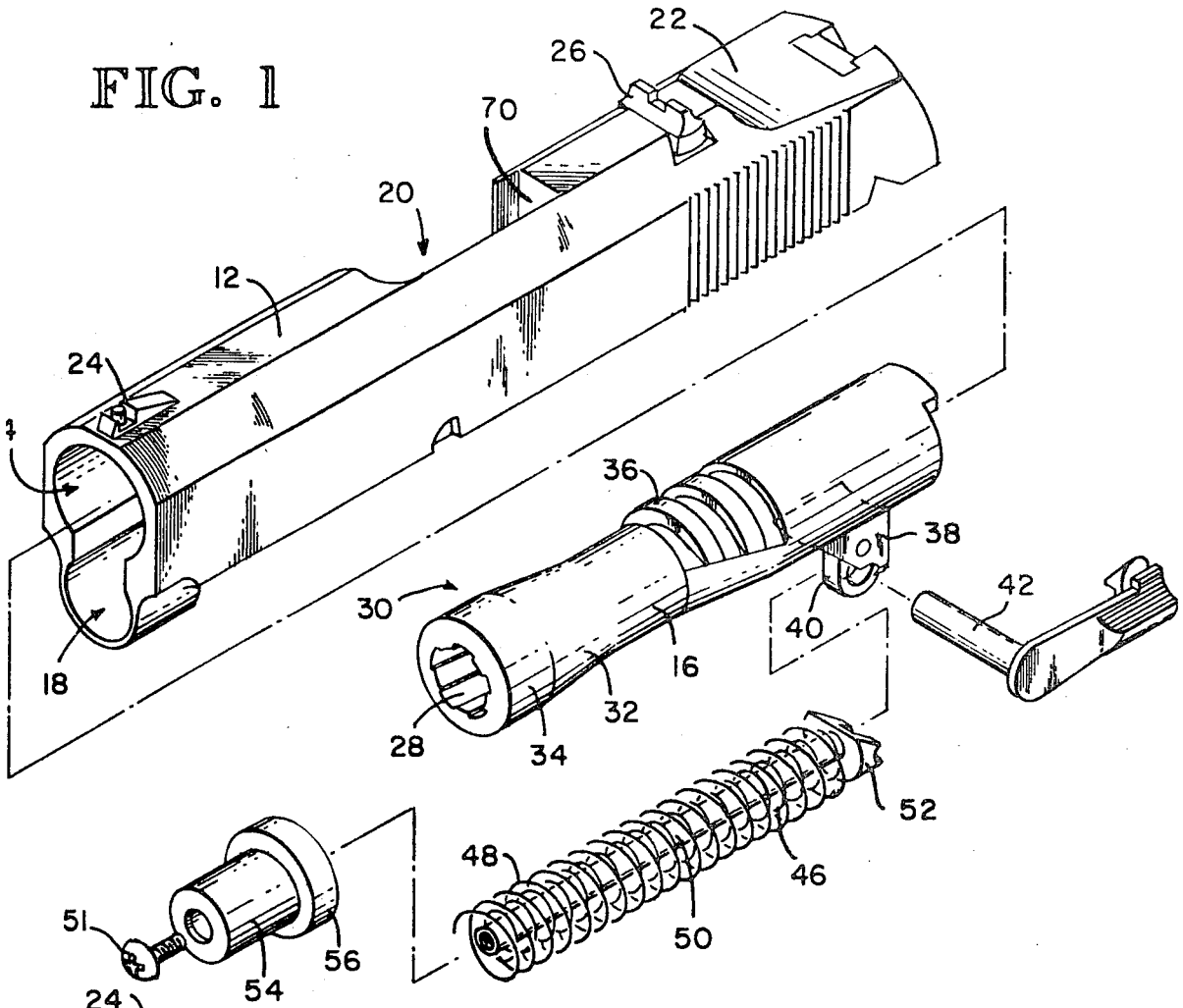
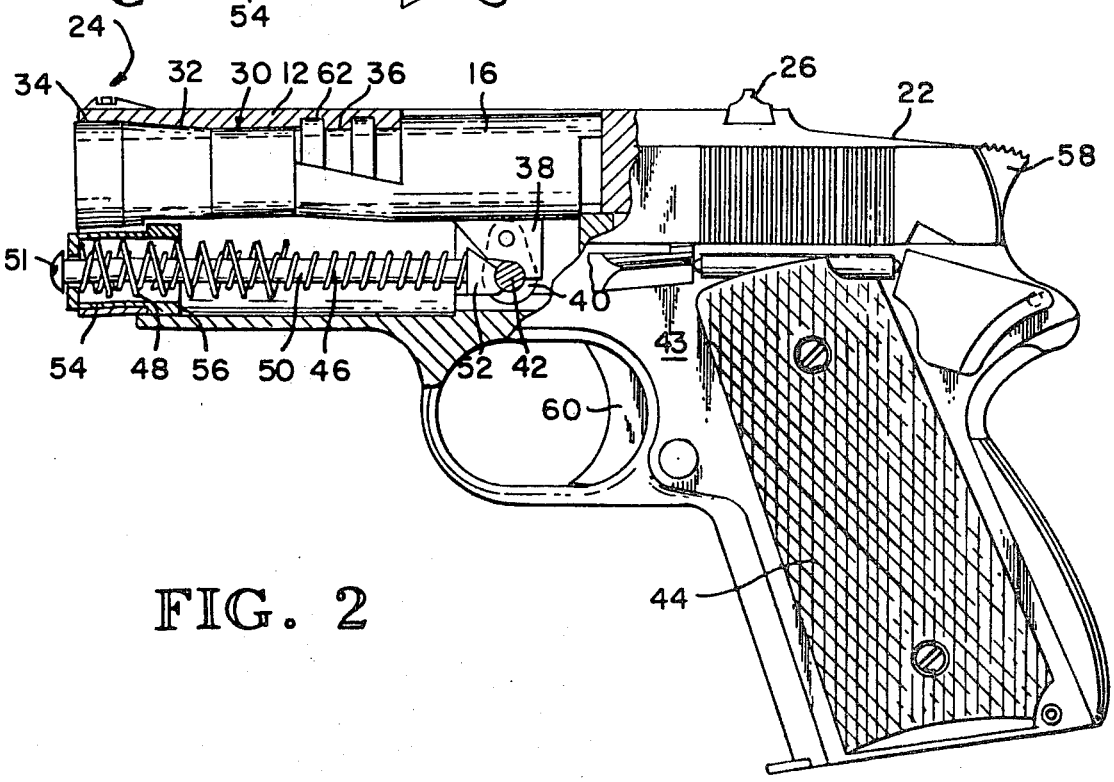
FIG. 2

SEMI-AUTOMATIC FIREARM

CROSS REFERENCE TO RELATED APPLICATIONS

This application is a continuation-in-part of abandoned application Ser. No. 692,297 filed June 8, 1976.

BACKGROUND OF THE INVENTION

1. Field of the Invention

This invention relates to semi-automatic firearms and, more particularly, to a semi-automatic firearm having a reduced apparent recoil, a relatively high degree of accuracy and a relatively compact shape.

2. Description of the Prior Art

It is often desirable to conceal semi-automatic firearms. Conventional large caliber semi-automatic firearms are relatively large and, therefor, they are relatively difficult to conceal. An apparent solution to the size problem is to simply scale down the size of these firearms, but because of the recoil forces present when the cartridge is fired this solution is not practical. With conventional large caliber semi-automatic firearms the slide must be of sufficient length to allow the recoil mechanism to absorb the shock when the weapon is fired in order to control the magnitude of the firearm's recoil. Consequently, there is a practical limit to the degree to which conventional large caliber semi-automatic firearms can be scaled down. Although springs of greater strength may somewhat alleviate this problem, size constraints limit the strength of the recoil spring which may be used.

A further problem associated with conventional automatic firearms is the protruding tangs on their hammers which reduce their handling capabilities. The hammers of conventional semi-automatic firearms project upwardly beyond the top surface of the slide, and this projecting portion is particularly prone to catching on such items as clothing when the firearm is rapidly being removed from its holster. Although attempts have been made in the prior art to remedy this disadvantage by reducing the size of the tang, the projecting tang is necessary to facilitate rapid thumbing of the hammer. Hence, removal of the projecting tang reduces the ease at which the firearm may be rapidly thumbed.

Another altogether different problem associated with conventional semi-automatic firearms are inaccuracies caused by the relatively loose play between the barrel and the slide particularly after the firearm has been extensively used. Design considerations dictate that there must be a somewhat loose fit between the slide and the barrel since the slide moves axially with respect to the barrel in order to absorb recoil shocks and to simultaneously eject a spent cartridge and insert a fresh cartridge into the firing chamber. However, the play between the barrel and slide allows the slide to move radially when the slide is at battery thereby seriously decreasing the accuracy of such firearms since these firearms are generally aimed by sighting along the slide and not the barrel.

SUMMARY OF THE INVENTION

It is an object of the invention to provide a semi-automatic firearm which is relatively compact and light in weight and is thus relatively easy to conceal.

It is another object of the invention to provide a semi-automatic firearm having improved recoil characteristics for absorbing recoil forces so that the firearm has a relatively light apparent recoil.

It is still another object of the invention to provide a semi-automatic firearm which utilizes a non-projecting hammer which, nevertheless, may be rapidly thumbed.

It is a further object of the invention to provide a semi-automatic firearm which provides greater inherent accuracy than conventional semi-automatic firearms.

These and other objects of the invention are provided by a semi-automatic firearm having a recoil mechanism which includes a pair of recoil springs extending between the slide and the firearm frame for urging the slide forwardly toward battery. The recoil springs may be concentrically mounted around an elongated spring guide and wound in opposite directions to prevent the inner spring from interfering with the outer spring so that the inner spring serves as a guide for the outer spring. The points of rearward slide movement at which the springs begin compression may be offset from each other to implement non-linear recoil characteristics. The slide may be cushioned at its maximum recoil position by a resilient cap which receives the forward end of the recoil spring. Extreme accuracies are provided by an improved barrel-slide interface which includes a link for pivotally securing the rear end of the barrel to the frame. In battery, the slide resiliently biases the barrel in a forward direction at a point diametrically spaced from the link thereby imparting a rotational moment to the barrel about the pivot axis of the link. The moment forces the front end of the barrel against a pair of spaced apart support areas on the slide so that the barrel is supported by three fixed points defining a stable plane. If desired a rearwardly extending sight may be secured to the forward end of the barrel so that the firearm is aimed by sighting along the barrel instead of the slide. The firearm utilizes a hammer which projects upwardly to a point below the top surface of the slide so that the firearm has a relatively low profile. The top surface at the rear end of the slide is sculptured to allow rapid thumbing of the low-profile hammer.

BRIEF DESCRIPTION OF THE FIGURES OF THE DRAWING

FIG. 1 is an exploded isometric view of the semi-automatic firearm illustrating the recoil mechanism, the forcing cone and the sculptured slide.

FIG. 2 is a fragmented, side elevational view of the semi-automatic firearm.

DETAILED DESCRIPTION OF THE INVENTION

Figure 3:
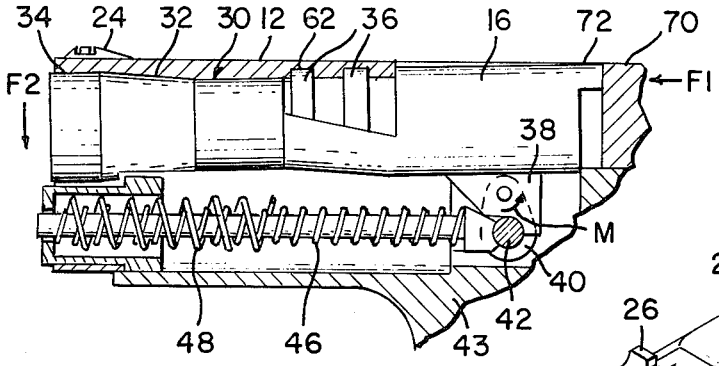
FIG. 3 is a fragmented, side elevational view illustrating the manner in which the front end of the barrel is supported by the slide.

The structural features of the inventive semi-automatic firearm are best illustrated in FIG. 1. The firearm includes a slide 12 having an upper forward opening 14 for a barrel 16 and a lower forward opening 18 for receiving a recoil spring cap as explained hereinafter. A cartridge ejection port 20 is formed in the slide 12 at its approximate midpoint. The top surface of the slide 12 at its rear end is sculptured at 22 to allow a hammer to be rapidly thumbed as explained hereinafter. A pair of sights 24,26 of somewhat conventional variety project upwardly from the top surface of the slide 12.

The barrel 16 has formed therein a conventional axial bore 28 extending the length of the barrel 16. The forward end of the barrel may diverge outwardly to form a cone 30 which may include a cylindrical land 34 in front of the outwardly tapering portion 32. As explained hereinafter, the land 34 contacts a pair of spaced apart support areas on the inside surface of the slide 12 when the slide 12 is in battery in order to prevent radial movement of the barrel 16 which would seriously degrade the accuracy of the firearm.

A plurality of circumferential locking lugs 36 are integrally formed in the barrel 16 rearward of the cone 30. As explained hereinafter, the locking lugs 36 lock the barrel 16 to the slide 12 during the initial portion of the rearward movement of the slide 12 caused by the recoil forces. The barrel 16 must be locked to the slide 12 during the initial portion of the recoil stroke so that the ejection port 20 remains sealed until after the bullet has left the barrel 16 and the gas pressure in the firing chamber (not shown) has been consequently reduced to a safe value. As explained hereinafter, the barrel 16 then remains stationary while the slide 12 continues to move rearwardly so that the spent cartridge may be ejected through the ejection port 20 and a fresh cartridge from a magazine (not shown) in the handle 44 of the firearm may be inserted into the chamber. After the slide 12 has moved rearwardly by the recoil forces, it is returned to battery by a recoil mechanism.

The recoil mechanism includes a pair of recoil springs 46,48 which are concentrically mounted with an elongated, cylindrical spring guide 50. One end of the guide 50 is fixedly secured to a pivot piece 52 while the other end extends through a cap 54 so that the guide 50 may slide with respect to the cap 54. A locking screw 51 is threaded into the forward end of the spring guide 50 to hold the recoil mechanism together during disassembly of the firearm. The pivot piece 52 contacts a slide lock pin 42 extending through the frame 43 of the firearm so the pivot piece 52 remains stationary. The pin 42 also engages a link 40 pivotally secured to a lug 38 extending downward from the barrel 16. As best illustrated in FIG. 2, the cap 54 is inserted into the opening 18 in the slide 12 from the rear so that a flange 56 on the cap 54 restrains the cap 54 against forward movement through the aperture 18. The position of the pivot piece 52 is fixed by the pin 42, and the forward ends of the springs 46,48 are biased against the cap 54 which is, in turn, received by the slide 12. Thus, the springs 46,48 bias the slide 12 in a forward direction. By using two recoil springs 46,48 instead of the conventional single recoil spring, the total force biasing the slide 12 forwardly is substantially greater than in conventional semi-automatic firearms. The increased force allows the use of a shortened slide 12 which is relatively light and thus alters the recoil characteristics to provide a lower apparent recoil than conventional semi-automatic firearms having a substantially longer, and hence heavier, slide. It is theorized at this time that the lighter weight slide, the reduced length of the recoil stroke and the increased force of the recoil springs cause the recoil process to occur at a much faster rate than in conventional firearms. Consequently the slide returns to battery before the recoil forces have caused the hand of the user to significantly deflect resulting in a faster return-to-target. It is not practical to increase the strength of the single recoil springs of conventional semi-automatic firearms since increasing the strength would also increase the lengths to which the springs could be compressed thus reducing the length of the recoil stroke. The springs 46,48 are prefereably wound in opposite directions so that they do not interfere with each other during compression. The radial position of the inner spring 44 is fixed by the guide 50, and the radial position of the outer spring 48 is fixed by the inner spring 46 which acts as a spring guide, since, by virtue of it having an opposite winding, intersects the outer spring 48 at approximately a right angle. Although both of the springs 46,48 are illustrated in FIG. 2 as being compressed with the slide in battery, non-linear recoil characteristics may be implemented by offsetting the point where one of the springs 46,48 begins to compress so that only one of the springs is compressed during the initial portion of the recoil stroke.

Figure 10:
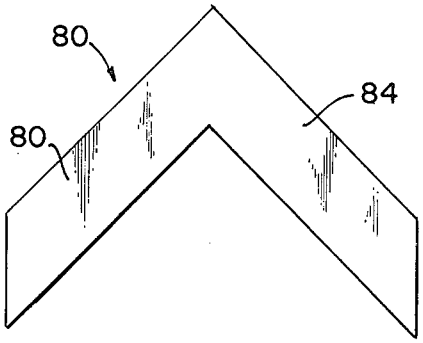
FIG. 10 is a plan view of a flat spring member shown in a planar condition.
Figure 11:
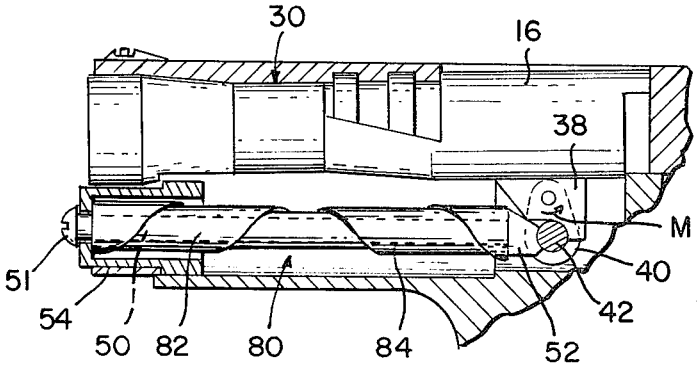
FIG. 11 is a fragmented, side elevational view of the spring of FIG. 10 installed in the firearm.

An alternative embodiment of a recoil spring is illustrated in FIGS. 10 and 11. The spring is formed by two perpendicular legs 82,84 having parallel outer ends. The spring 80 is wound about the sprung guide 50 as illustrated in FIG. 11. When the slide 12 is out-of-battery the legs 82,84 slide past each other as the spring 80 resiliently deforms.

As illustrated in FIG. 2, the semi-automatic firearm utilizes a relatively small hammer 58 which projects upwardly to a point below the top surface of the slide 12. As a result, the hammer 58 is thus less able to catch such things as articles of clothing particularly when the firearm must be maneuvered very rapidly such as under combat conditions. The scalloped portion 22 of the slide 12, as described above, lowers the surface of the slide 12 in front of the hammer 58 to allow the hammer 58 to be rapidly thumbed.

Figure 4:
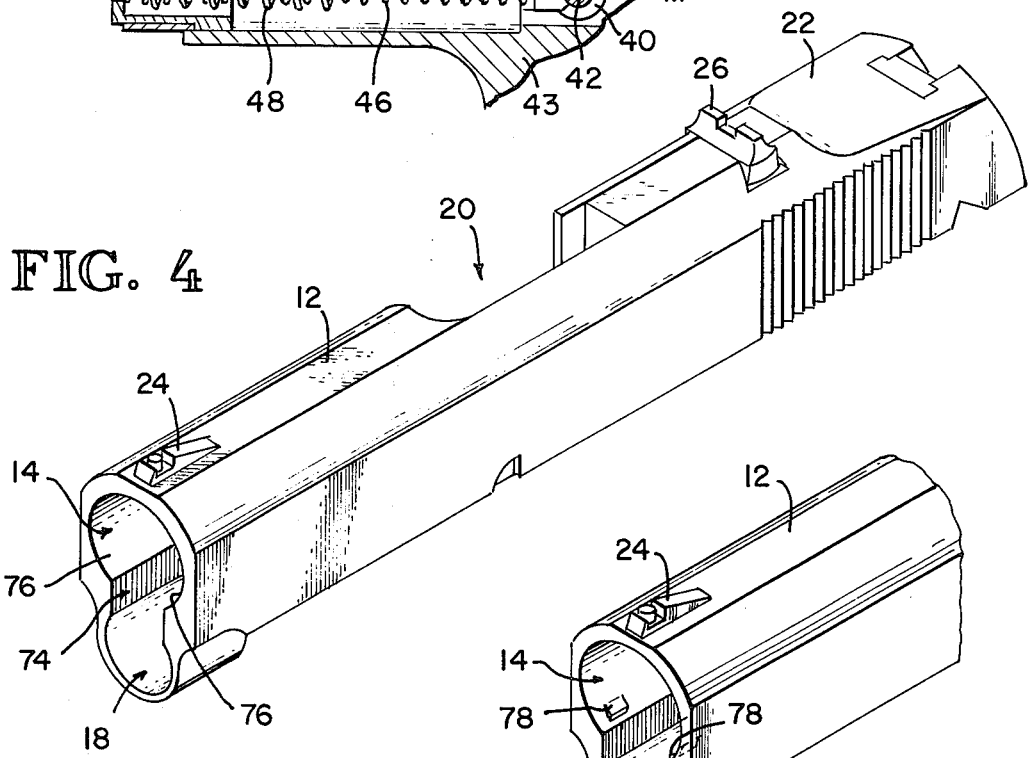
FIG. 4 is an isometric view of the slide illustrating the location of the support areas where the front end of the barrel contacts the slide.
Figure 6:
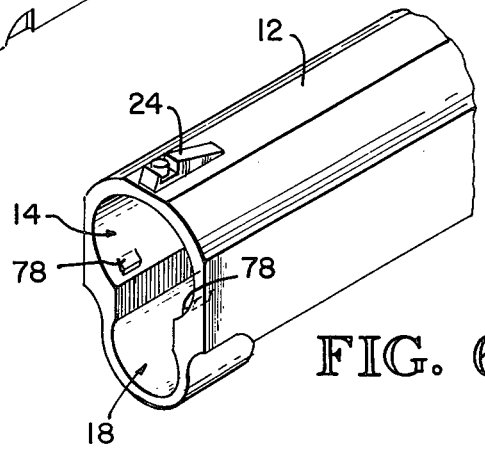
FIG. 6 is a partial isometric view of the slide showing an alternate barrel supporting technique.

The manner in which the barrel 16 is supported by the slide 12 can thus be visualized with reference to FIG. 3. When the slide 12 is in battery, the locking lugs 36 are inserted in the grooves 62, and the rear wall 70 of the ejection port 20 (FIG. 1) abuts a rearwardly extending projection 72 formed at the rear end of the barrel 16. Since the slide 12 is resiliently biased in a forward direction by the recoil springs 46, 48, the slide 12 also resiliently biases the barrel 16 in a forward direction with respect to the frame 43. Since the force $F_1$ is applied to the barrel 16 by the slide at a point spaced from the pivot axis of the link 40, a counterclockwise rotational moment M is generated around the pivot axis of the link 40. The moment M generates a downward force $F_2$ at the forward end of the barrel. It will be understood that the radius of curvature of the land 34 must be less than the inside radius of curvature of the opening 14 (FIG. 4) in order for the barrel 16 to be contained within the slide 12. The downward force $F_2$ places the front end of the barrel 16 within a slot 74 formed at the front end of the slide 12 between openings 14,18. Consequently the barrel 16 abuts a pair of support areas 76 spaced apart by the opening 74. The exact location for the support areas 76 will, of course, vary slightly from one firearm to another. However, it is important to note that the position of the support areas 76 for a given firearm will be substantially constant so that the performance of the firearm varies only slightly after the firearm has been used for a substantial period. Alternatively, inwardly projecting supports 78 may be formed in the slide 12 so that the location of the contact points between the slide 12 and barrel 16 may be predetermined. The advantageous feature of the barrel mounting structure is that the barrel is supported on three points—the two support areas 76 and the link 40—which define a stable mounting platform for the barrel 16. Conventional mounting system, such as those using bushings, attempt to tightly grip the front end of the barrel in a large number of places which tend to allow radial movement of the barrel as the firearm wears. However, by supporting the rear end of the barrel 16 at a single point and the front end of the barrel 16 at two spaced apart points, the position of the barrel 16 remains constant as the firearm is fired. Although the front end of the barrel 16 is illustrated herein as including a cone 30 formed by a diverging portion 32 terminating in a cylindrical land 34, it will be understood that other barrel designs such as constant diameter cylindrical barrels, may also be advantageously used. However, the conical shape smoothly guides the barrel 16 out of and into the guide 12 as the slide moves rearwardly and then forwardly when the firearm is discharged.

The remaining portions of the firearm which have been specifically described are, except for minor structural differences, substantially identical to those same items as found in conventional, semi-automatic firearms.

The operation of the firearm is best explained with reference to FIGS. 2 and 3. The firearm is shown with the slide 12 in battery. The slide 12 is then contacting the barrel 16 through the locking lugs 36 and projection 72 so that the front end of the barrel is resiliently biased downwardly against the support areas 76. Under these circumstances the barrel is supported on three fixed points which define a stable mounting plane. The hammer 58 is initially cocked either by thumbing it rearwardly or by moving the slide 12 rearwardly so that the rear end of the slide 12 contacts the forward surface of the hammer 58 and carries it rearwardly. In either case, when the hammer 58 is cocked and the slide 12 is in its forward position, the hammer 58 is released by actuating a trigger 60 thereby initiating the cartridge in the firing chamber (not shown) in a conventional manner. As the bullet leaves the barrel 16 the recoil forces move the slide 12 rearwardly. Since the lugs 36 are then engaging respective grooves 62 on the inner surfaces of the slide 12, the barrel 16 moves rearwardly along with the slide 12 as explained above. However, since the link 40 is pivotally connected to the pin 42 and the lug 38, the barrel 16 moves rearwardly with the slide 12 only until the link 40 pulls the rear end of the barrel 16 downwardly so that the locking lugs 36 clear the grooves 62. Subsequently, the slide 12 continues to move rearwardly toward the full recoil position, but the barrel 16 which is secured to the frame through link 40 and pin 42, remains stationary.

Figure 8:
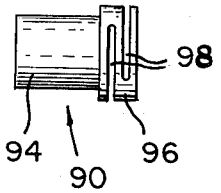
FIG. 8 is a side elevational view of one embodiment of a resilient cap which receives the forward end of the recoil spring and cushions the slide at its full recoil position.
Figure 9:
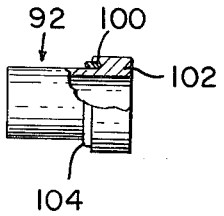
FIG. 9 is a side elevational view of an alternative embodiment of a resilient cap for cushioning the slide at its full recoil position.

When the slide 12 moves rearwardly, the rear end of the slide 12 contacts the forward surface of the hammber 58 carrying the hammer 58 rearwardly to a cocked position. At the same time, the spent cartridge is ejected from the firing chamber through the ejection port 20 and a fresh cartridge is inserted into the chamber from the clip in the handle 44. When the slide is in its full recoil position the rear face of the cap 50 contacts the forward edge of the body 43 in front of the pin 42. Since the momentum of the slide is quite large, the cap 50 receives considerable forces as it terminates the recoil stroke. Hence it may be desirable to utilize one of the resilient caps 90, 92 illustrated in FIGS. 8 and 9, respectively. The resilient cap 90 includes a narrowed cylindrical portion 94 received in the opening 18 (FIG. 1) of the slide 12, and an increased thickness cylindrical portion 96 having a plurality of transverse, alternating slits 98 which allow the portion 96 to resiliently deform responsive to axial forces imparted to the portion 96 by the body 43 at the full recoil position. Alternatively the cap 92 illustrated in FIG. 9 may be employed. The cap 92 is substantially identical to the cap 50 illustrated in FIGS. 1–3 except that a rearwardly opening annular slot 100 is formed in the cylindrical portion 102 which receives a resilient ring 104. The ring 104 absorbs the forces imparted to the cap 92 by the body 43 at the full recoil position. The recoil springs 46, 48 then urge the slide 12 forwardly to battery as illustrated in FIG. 2. The reduced size of the inventive automatic firearm made possible by the unique recoil mechanism coupled with the relatively short hammer makes the firearm extremely easy to handle and conceal. The firearm is also inherently accurate due to the three point barrel support system as well as the altered recoil characteristics which allow the user to more easily and more quickly return the firearm to a firing position.

Figure 7:
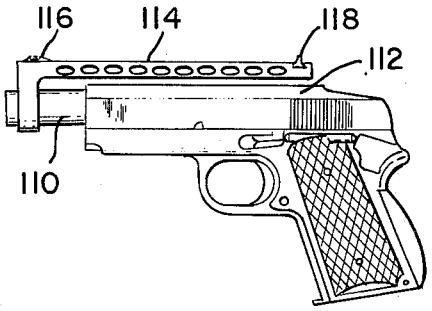
FIG. 7 is a side elevational view of the firearm with the barrel extending forwardly beyond the front end of the slide, and having a rearwardly extending sight secured to the forward end of the barrel.
Figure 5:
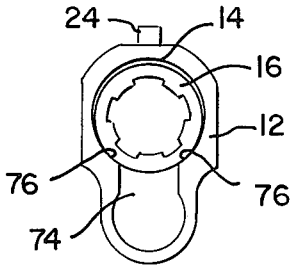
FIG. 5 is a schematic illustrating the manner in which the barrel support areas are formed.

Semi-automatic firearms are generally aimed by sighting along the slide; not by sighting along the barrel. Consequently, any radial movement of the barrel with respect to the slide inherently reduces the accuracy of such firearms. This problem may be rectified as illustrated in FIG. 7 by extending the barrel 110 forwardly beyond the front end of the slide 112, and mounting a rearwardly extending sight 114 on the barrel 110. The top surface of the sight 114 includes a forward sight post 116 and a rear sight bracket 118. The sight 114 may be provided with a plurality of holes to reduce its weight. Since the position of the sight 114 is determined by the position of the barrel 110, variations in barrel position with respect to the slide 112 have no effect on the accuracy of the firearm.

We claim:

1. In a semi-automatic firearm having a firing chamber, a barrel, a frame, a slide movable with respect to said barrel and said frame between battery and full recoil positions, means for sequentially ejecting a spent cartridge and loading a fresh cartridge during each recoil stroke, and a firing mechanism for selectively initiating said cartridge when said slide is in battery, the improvement comprising a recoil mechanism for allowing the recoil of said cartridge to carry said slide rearwardly toward said full recoil position, and for subsequently returning said slide to its battery position, said recoil mechanism including first and second recoil springs each extending between said frame and said slide, said improvement further including barrel guide means for fixing the radial position of the forward portion of said barrel when said slide is in battery position, said guide means including barrel mounting means at the forward end of said slide for supporting said barrel at the forward end thereof on two discrete, spaced apart, substantially immovable support areas symmetrically positioned about the central axis of said slide beneath said barrel when said slide is in battery position, and linkage means pivotally securing said barrel to said frame at a point rearward of and between said support areas, and diametrically spaced from an area of contact between said slide and barrel such that the force of said barrel exerted by said slide in a forward direction generates a rotational moment about the pivot axis of said linkage means for resiliently biasing the forward end of said barrel against said support areas.

2. The semi-automatic firearm of claim 1 wherein a notch is formed at the front end of said slide beneath said barrel and wherein the outside diameter of aid barrel is slightly smaller than the inside diameter of said slide thereby forming said support areas on opposite sides of said notch.

3. The semi-automatic firearm of claim 1 wherein said support areas are formed by a pair of spaced apart projections at the forward end of said slide beneath said barrel extending inwardly to contact the forward end of said barrel.

4. The semi-automatic firearm of claim 1 wherein the outer surface of said barrel diverges outwardly at the forward end thereof for smoothly guiding said barrel out of and into said slide as said slide moves rearwardly and then forwardly when said firearm is fired.

5. In a semi-automatic firearm having a firing chamber, a barrel, a frame, a slide resiliently biased in a forward direction and movable with respect to said barrel and said frame between battery and full recoil positions, said slide contacting said barrel at a contact area when said slide is in its battery position such that said slide resiliently biases said barrel forwardly with respect to said frame, means for sequentialy ejecting a spent cartridge and loading a fresh cartridge during each recoil stroke, a firing mechanism for selectively initiating said cartridge when said slide is in its battery position, the improvement comprising barrel guide means for fixing the radial position of the forward portion of said barrel when said slide is in battery position, said guide means including barrel mounting means at the forward end of said slide for supporting said barrel at the forward end thereof on two discrete, spaced apart, substantially immovable support areas symmetrically positioned about the central axis of said slide beneath said barrel when said slide is in battery position and linkage means pivotally securing said barrel to said frame at a point rearward of and between said support areas and diametrically spaced from the contact area between said slide and barrel such that the force on said barrel exerted by said slide in a forward direction generates a rotational moment about the pivot axis of said linkage means for resiliently biasing the forward end of said barrel against said support areas.

6. The semi-automatic firearm of claim 5, wherein a notch is formed at the front end of said slide beneath said barrel and wherein the outside diameter of said barrel is slightly smaller than the inside diameter of said slide thereby forming said support areas on opposite sides of said notch.

7. The semi-automatic firearm of claim 5 wherein said support areas are formed by a pair of spaced apart projections at the forward end of said slide extending inwardly to contact the forward end of said barrel.

8. The semi-automatic firearm of claim 5, wherein the outer surface of said barrel diverges outwardly at the forward end thereof for smoothly guiding said barrel out of and into said slide as said slide moves rearwardly and then forwardly when said firearm is fired.

9. The semi-automatic firearm of claim 5 wherein said slide is resiliently biased in a forward direction by first and second recoil springs extending between said frame and side.

10. The semi-automatic firearm of claim 9, further including an elongated spring guide extending between said frame and said slide, and wherein said first and second springs are concentrically mounted about said spring guide.

11. The semi-automatic firearm of claim 10, wherein said first recoil spring is helically wound in one direction and said second recoil spring is helically wound in the opposite direction thereby preventing said first and second recoil springs from interfering with each other during deformation, and allowing the spring having a smaller diameter to act as a spring guide for the spring having a larger diameter.

12. The semi-automatic firearm of claim 5 wherein said slide is resiliently biased in a forward direction by a recoil spring extending between said frame and slide, said spring having a pair of planar, resilient legs joining each other at a right angle with the ends of said legs being parallel with each other, said legs being oppositely wound about a common axis.

13. A semi-automatic firearm of claim 5, wherein said firing mechanism includes a hammer resiliently biased in a forward direction and firing means for latching said hammer in a cocked position and selectively releasing said hammer responsive to actuation of a trigger, said hammer projecting upwardly in its released position to the level below the top surface of said slide thereby facilitating withdrawal of said firearm from a holster, and wherein the top surface at the rear end of said slide is sculptured to a depth approximately equal to the upwardly projecting end of said hammer when said hammer is in its released position thereby allowing said hammer to be rapidly thumbed.

14. The semi-automatic firearm of claim 5 wherein said barrel extends forwardly beyond the front end of said slide when said slide is in battery position, said forwardly extending barrel carrying a sight extending rearwardly above said slide such that the position of said sight corresponds to the position of said barrel regardless of the radial position of said barrel with respect to said slide.

15. The semi-automatic firearm of claim 5 wherein said slide is resiliently biased in a forward direction by a recoil spring extending between said frame and slide, the forward end of said recoil springs being received a cylindrical cap, and wherein the rear face of said cap contacts a portion of said frame when said slide is in full recoil position, said cap including resilient means for allowing limited relative movement between the front face of said cap and said slide when said slide is in full recoil position.

16. The semi-auotmatic firearm of claim 15 wherein said resilient cap includes a cylindrical portion of spring metal having a plurality of oppositely facing, spaced apart transverse slots formed therein.

17. The semi-automatic firearm of claim 15 wherein said resilient cap includes an annular body of the formable material extending around said cap and positioned between said cap and slide such that said resilient material absorbs recoil shocks by deforming as said cap contacts said frame when said slide is in full recoil position.

* * * * *